US005659993A

United States Patent [19]

Watson, Jr. et al.

[11] Patent Number: 5,659,993

[45] Date of Patent: Aug. 26, 1997

[54] COMBINATION PIN FOR ATTACHING TRIGGER ASSEMBLY AND SAFING SMALL ARM

[75] Inventors: Fred W. Watson, Jr., Montross; William M. Canaday, King George, both of Va.

[73] Assignee: The United States of America as represented by the Secretary of the Navy, Washington, D.C.

[21] Appl. No.: 514,570

[22] Filed: Aug. 14, 1995

[51] Int. Cl.[6] ..... F41A 17/28; F41A 17/22

[52] U.S. Cl. ..... 42/70.04; 42/70.05; 42/70.06

[58] Field of Search ..... 42/70.11, 70.01, 42/70.06, 70.08, 70.04, 70.05

[56] References Cited

U.S. PATENT DOCUMENTS

| | | | |
|---|---|---|---|
| 565,678 | 8/1896 | Foster | 42/70.08 |
| 1,840,478 | 1/1932 | Von Frommer . | |
| 1,911,494 | 5/1933 | Floyd . | |
| 2,444,649 | 7/1948 | Jacobs | 42/70 |
| 3,018,576 | 1/1962 | Riechers | 42/1 |
| 3,031,787 | 5/1962 | Womble, Jr. | 42/70 |
| 3,352,047 | 11/1967 | McDonnell | 42/70 |
| 3,673,725 | 7/1972 | Cravener | 42/1 R |
| 4,719,713 | 1/1988 | Hagle | 42/70.06 |
| 4,754,568 | 7/1988 | Brandt | 42/70.06 |

FOREIGN PATENT DOCUMENTS

| | | | |
|---|---|---|---|
| 2245497 | 3/1974 | Germany | 42/70.06 |
| 664737 | 1/1952 | United Kingdom | 42/70.06 |

*Primary Examiner*—Stephen M. Johnson
*Attorney, Agent, or Firm*—James B. Bechtel, Esq.

[57] ABSTRACT

A dual-purpose safety and retaining pin which performs the functions of safing the trigger assembly for a small arm and of securing the trigger assembly to the weapon is provided. The pin comprises a handle attached to a retainer and pin assembly which can be rotated to select safe or arm positions. The retainer and pin assembly is oriented in a specific rotational position with respect to the handle so that safing by rotating the pin can be accomplished. The pin has a cam configuration whereby rotation of the pin causes the cam to move a trigger connector link into contact with a hammer sear. This action enables the weapon. When the pin is rotated to the safe position or when the pin is removed from the trigger housing, the weapon is disabled. The pin is held in position by a plunger-ball locking arrangement. The single spring used to extend the plunger also acts as a detent engaging spring for securing the rotational position of the pin.

6 Claims, 6 Drawing Sheets

COMBINATION PIN FOR ATTACHING TRIGGER ASSEMBLY AND SAFING SMALL ARM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to the field of gun safety devices and in particular to safety pins for small arms.

BACKGROUND OF THE INVENTION

A variety of devices for safing trigger assemblies is known in the art. There are numerous examples of trigger blocking mechanisms and numerous examples of trigger guard covers which prevent access to the trigger. Additionally, there are a few examples of insertable pins designed to disable the weapon whenever the pin is removed. One such example is U.S. Pat. No. 3,673,725 by James A. Cravener wherein a pin is inserted into a small arm in order to enable operation. Although Cravener states that a device such as his is impractical for field use, certain small arms require disassembly in the field. An example is the Shoulder-Launched Multi-purpose Assault Weapon (SMAW), wherein removal of the trigger assembly is sometimes required to clear certain malfunctions. The SMAW is a rocket launcher/spotting rifle combination configured in an over-and-under design with the rocket launcher tube over the spotting rifle. During removal of the trigger assembly in this weapon, it is essential that both the rocket firing mechanism and spotting rifle be properly safed. Additionally, it is desirable that the two firing mechanisms remain safe during re-assembly of the weapon.

SUMMARY OF THE INVENTION

Accordingly, it is an object of the present invention to provide a combination safety and retaining pin which provides safe and arm positions when installed.

It is another object of the invention to provide a combination safety and retaining pin which attaches a trigger housing to a small arm.

It is yet another object of the invention to provide a combination safety and retaining pin which safeties the trigger assembly when the pin is removed.

It is still another object of the invention to provide a safety and retaining pin which must be removed prior to removal of the trigger assembly.

Accordingly, the invention is a dual-purpose safety and retaining pin which performs the functions of safing the trigger assembly for a small arm and of securing the trigger assembly to the weapon. The pin comprises a handle attached to a retainer and pin assembly which can be rotated to select safe or arm positions. The retainer and pin assembly is oriented in a specific rotational position with respect to the handle so that safing by rotating the pin can be accomplished. The pin has a cam configuration whereby rotation of the pin causes the cam to move a trigger connector link into contact with a hammer sear. This action enables the weapon. When the pin is rotated to the safe position or when the pin is removed from the trigger housing, the weapon is disabled. The pin is held in position by a plunger-ball locking arrangement. The single spring used to extend the plunger also acts as a detent engaging spring for securing the rotational position of the pin.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
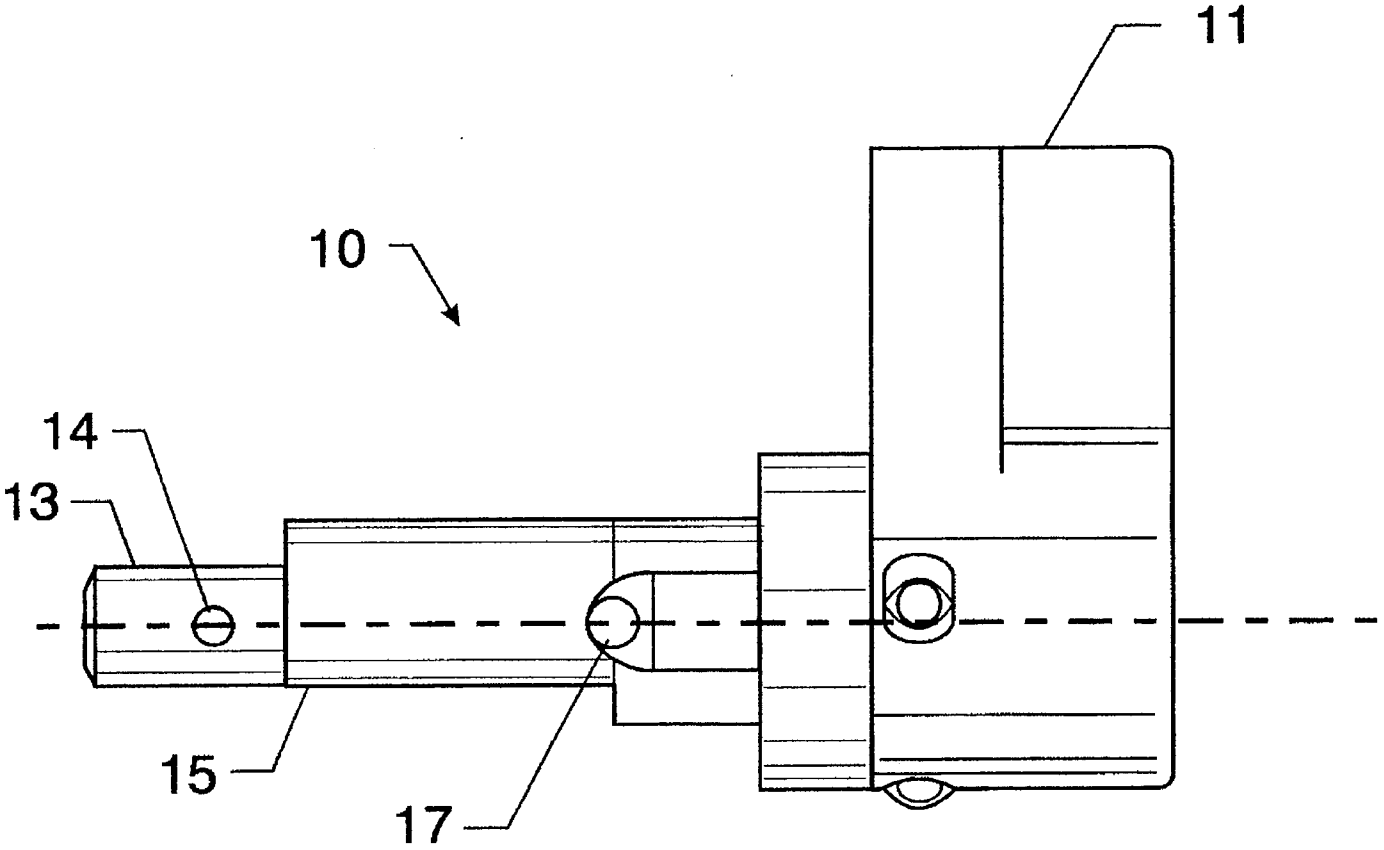
FIG. 1 is a side view of the combination pin.

Referring now to FIG. 1, the combination pin, designated generally by the reference numeral 10, for attaching and safing a small arm trigger assembly is shown with its external features. The combination pin 10 comprises a handle 11 attached to a retainer pin and cam assembly, the retainer pin 13 having a ball-locking mechanism 14. The cam 15 provides an eccentric movement during rotation in order to enable the trigger assembly. At the end of the cam 15 nearest handle 11, a detent-engagement mechanism 17 is affixed.

Figure 2:
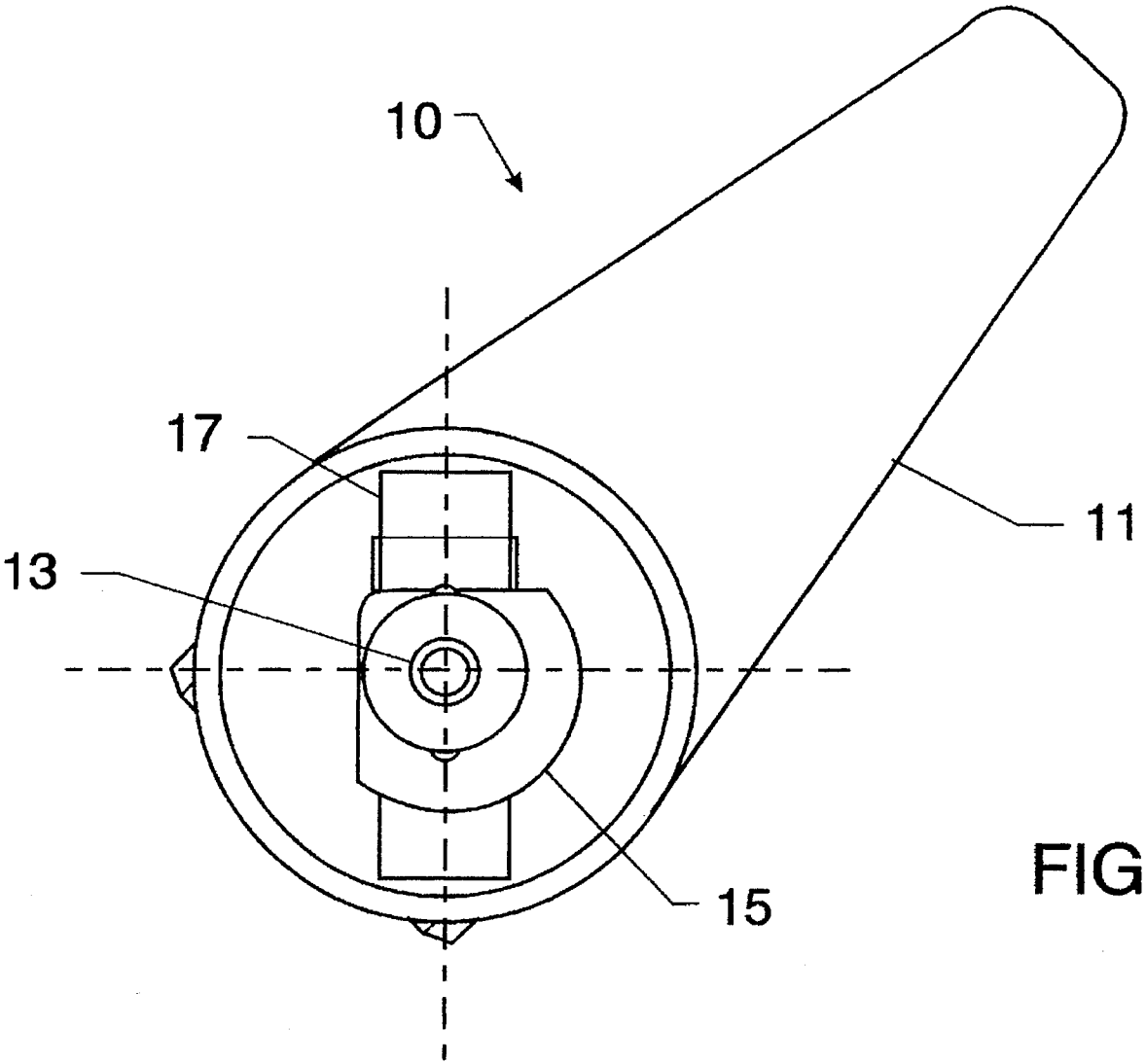
FIG. 2 is an end view of the combination pin.

The shape of the combination pin 10 components may be further understood by reference to FIG. 2. The handle 11 is rotationally fixed in relation to cam 15 so that the extended cam covers a one-half circle on the lower right side of the handle 11. With the handle 11 in this position, the safety detent engagement mechanism 17 is at the top location, 45° away from the center line of handle 11 and located on the noncam side of the retainer pin 13.

Figure 3:
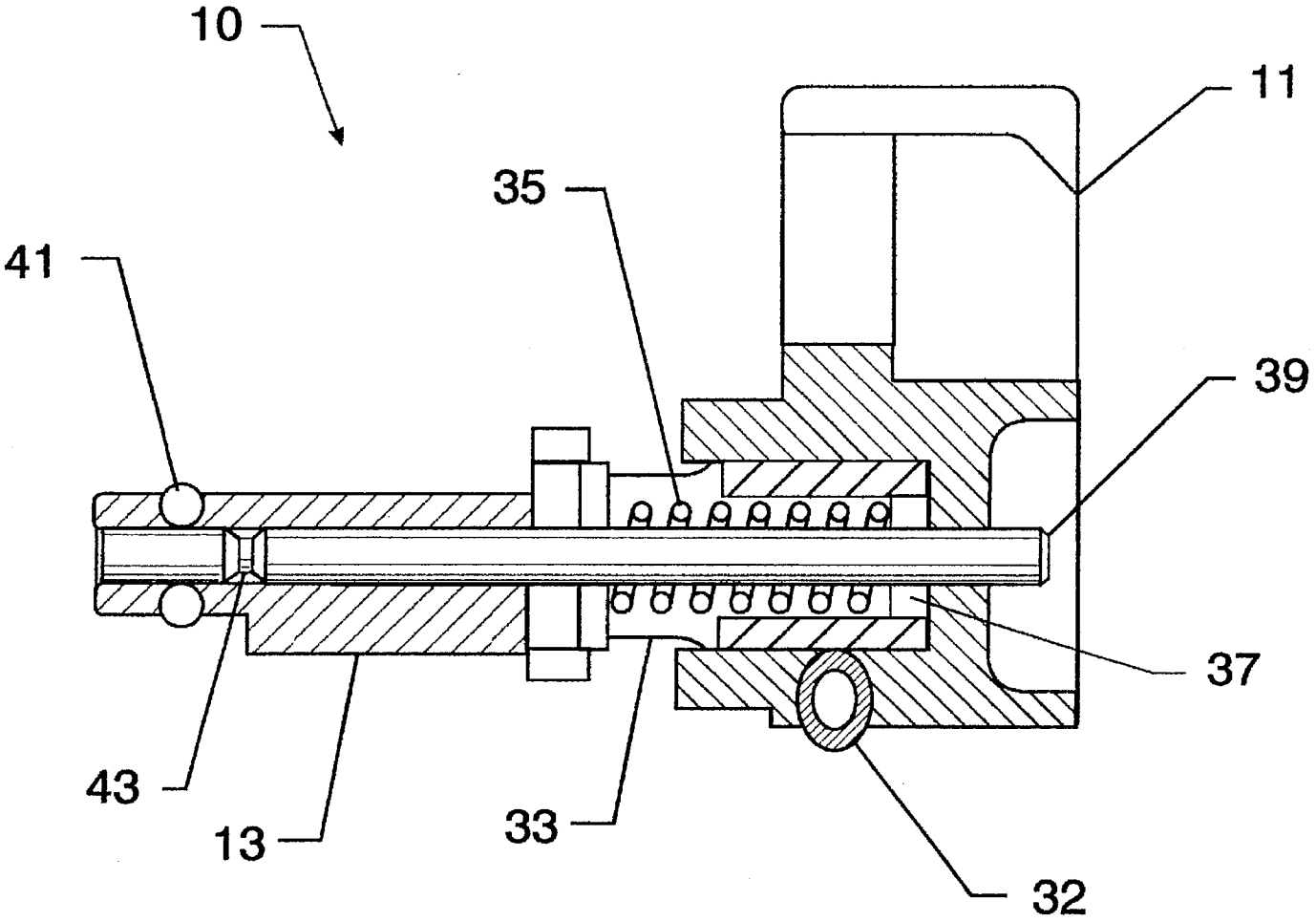
FIG. 3 is a sectional side view of the combination pin.

Referring now to FIG. 3, a sectional view of the combination pin 10 shows the internal mechanism with the assembly. Handle 11 is attached to the retainer pin and cam assembly 13 and is held in place by spring pin 32. The retaining pin and cam assembly (shown with narrow cross-hatching) extends from inside handle 11 to the insertion end of the device. The retainer pin and cam assembly is a single piece housing having a smaller center bore on the insertion end and a larger center bore on the handle end. Two slots 33 are cut through the assembly to allow movement of the detent-engagement mechanism. A dual-action spring 35 presses the detent-engagement mechanism toward the insertion end of the combination pin. The dual-action spring 35 also presses against washer 37 which is affixed to the ball locking rod 39. This action urges the ball-locking rod 39 toward the handle end of the combination. With the ball locking rod in the position shown (outward toward the handle), the locking balls 41 cannot retract and the combination pin 10 is held in place to secure a trigger assembly to a weapon. When ball-locking rod 39 is pressed inward from the handle 11, the locking balls 41 are aligned with the groove 43 in the locking rod 39 thereby releasing the pin and the entire combination pin can then be removed from the trigger assembly.

Figure 4:
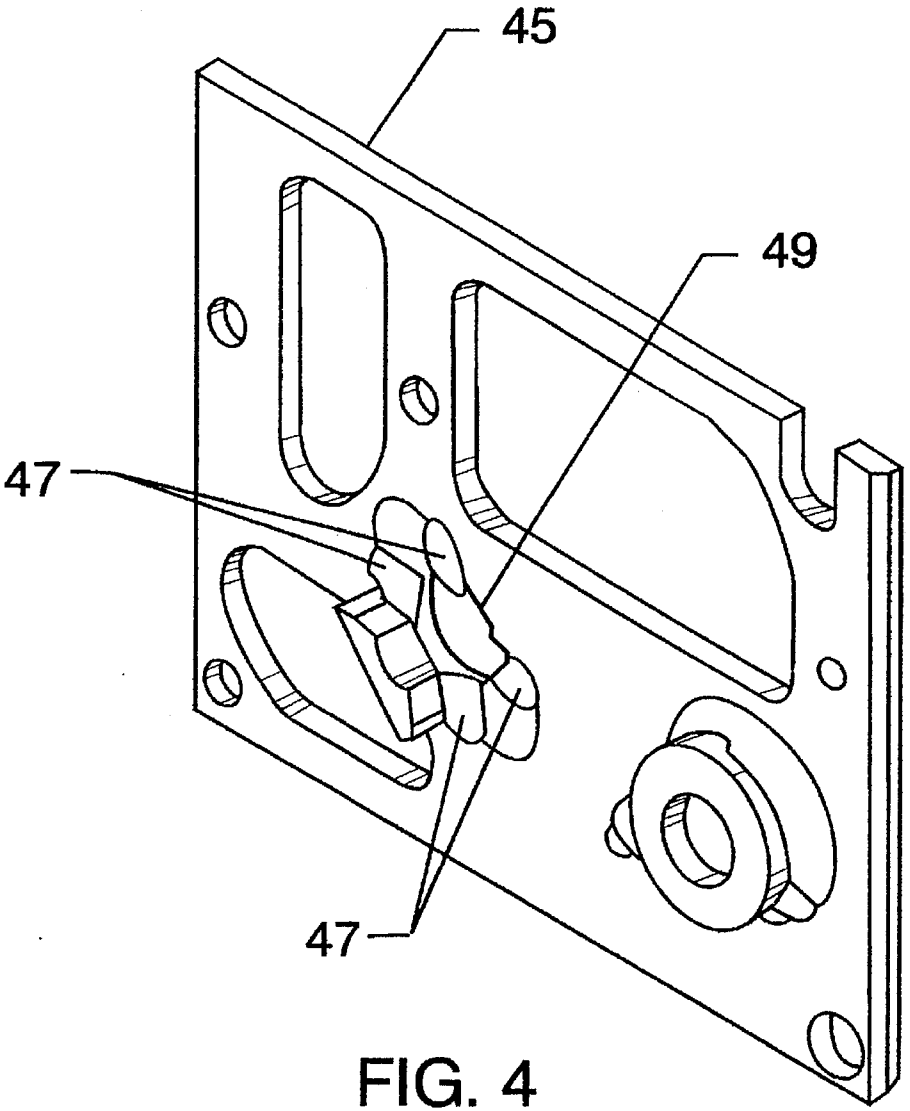
FIG. 4 is a perspective view of a trigger housing plate.

FIG. 4 shows a trigger housing plate 45 which mates with the combination pin to provide detents 47 for the detent-engagement mechanism. Aperture 49 is shaped to match the cam shape of the combination pin thereby allowing insertion of the combination pin only in the safe position. After insertion, the combination pin may be rotated to arm the weapon.

Figure 5:
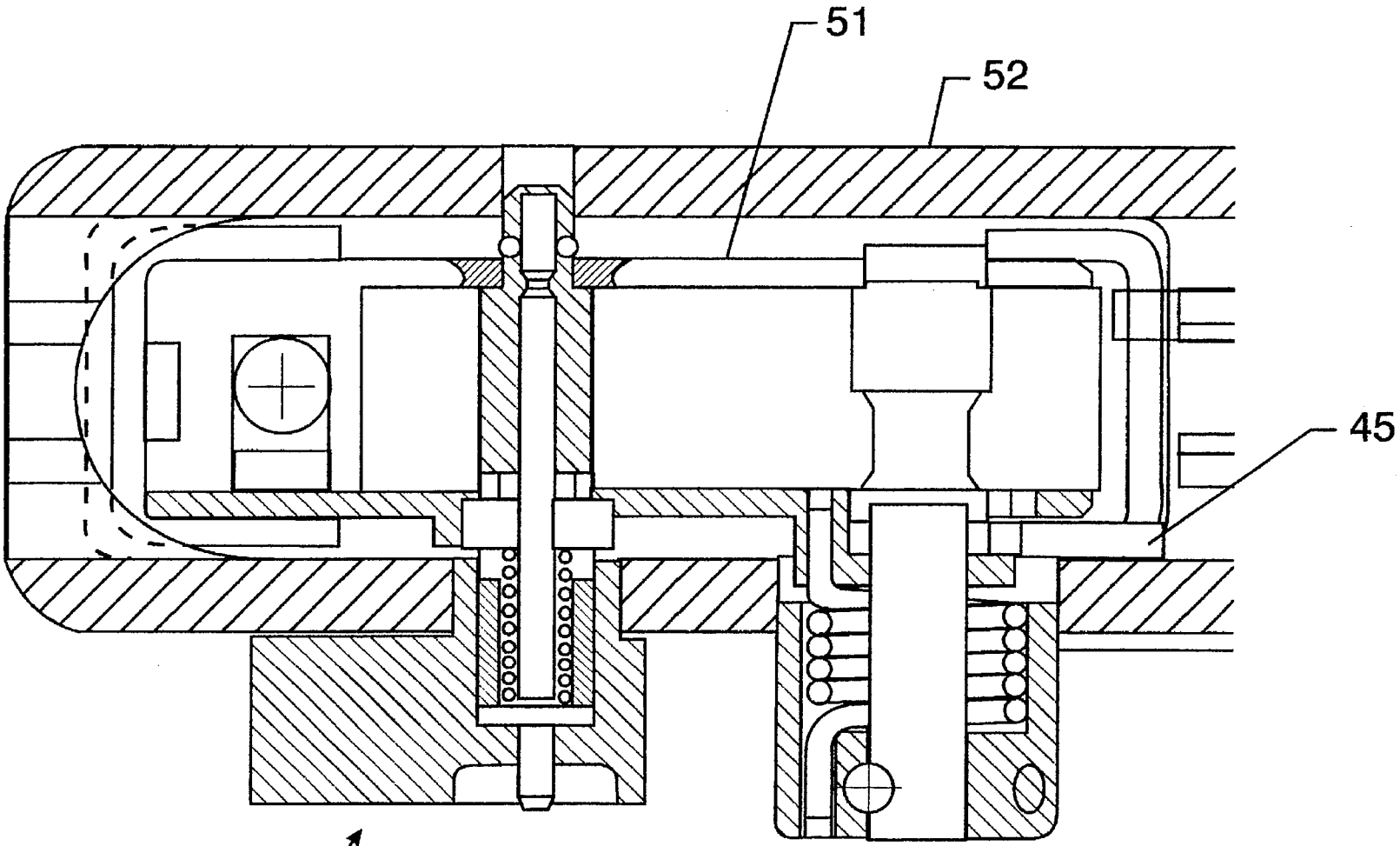
FIG. 5 is a cross-sectional top view showing the combination pin installed in a trigger assembly.

Referring now to FIG. 5, the combination pin 10 is shown inserted in the trigger assembly 51 of a typical weapon 52. This installation represents a trigger assembly attached to a Shoulder-Launched Multi-purpose Assault Weapon (SMAW). The depiction is a top view looking downward. The trigger assembly is inserted into the weapon from the bottom and the combination pin is then inserted from the side as shown. As the cam action of the pin is required to enable the weapon, the weapon is safe whenever the pin is removed. Additionally, due to the shape of the aperture, the combination must be inserted in the safe position and fully seated before it can be rotated to the arm position. This feature means that the safety of emergency field disassembly of the weapon is greatly enhanced.

Figure 6:
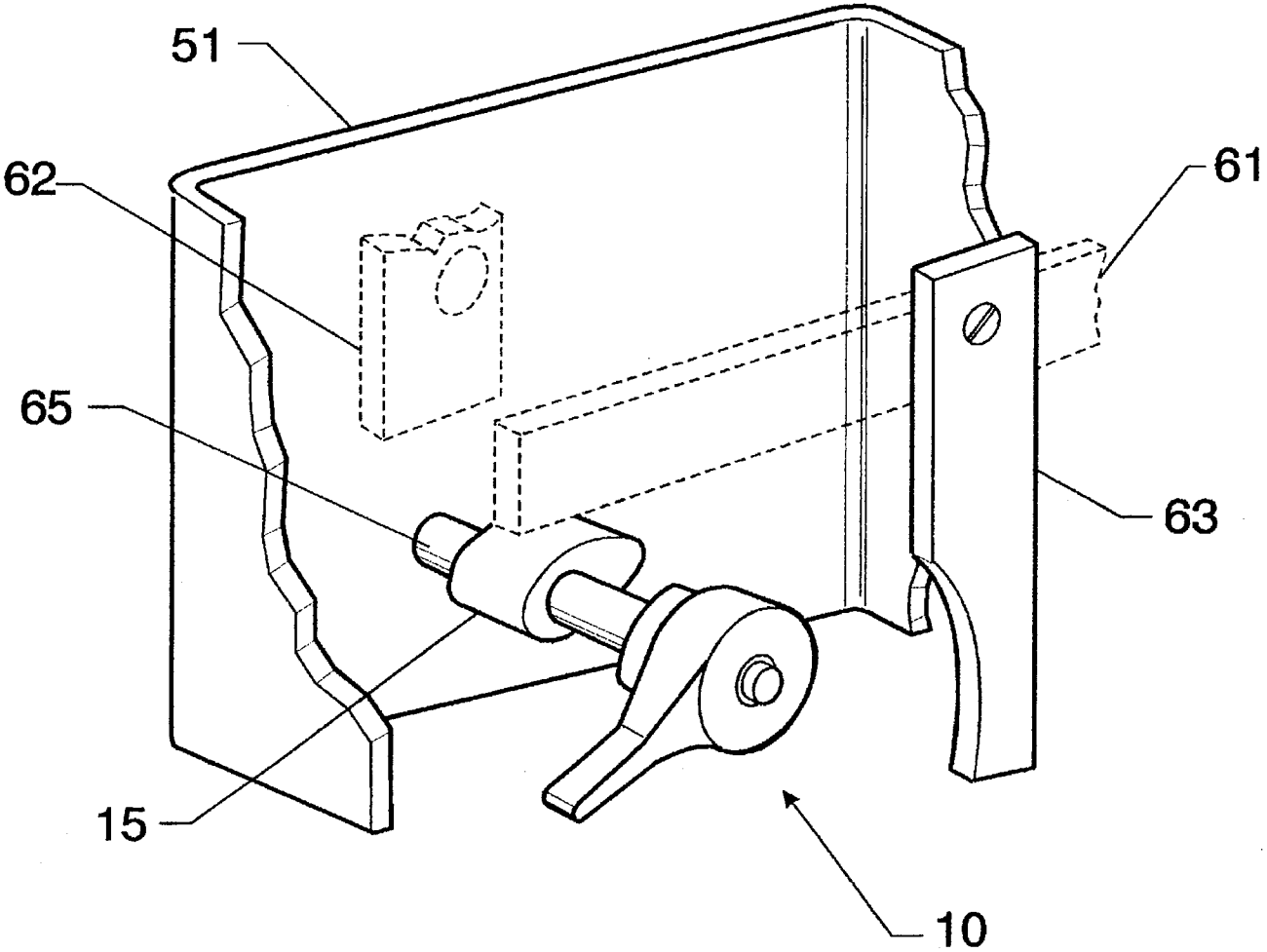
FIG. 6 is a perspective view of a trigger assembly.

FIG. 6 depicts a typical trigger assembly 51 which may be secured to a small arm using the combination pin 10 of the present invention. Combination pin 10 is inserted through aperture 65 to secure the trigger assembly 51 to a small arm. In this embodiment, the action of cam 15 acts on a sear connector link 61 (shown in phantom in FIG. 6) raising it when rotated to a ruing position so as to engage a sear 62. When trigger 63 is pulled, the sear releases the hammer. The depiction in FIG. 6 is intended to reflect safing mechanisms conventionally known in the art. However, the combination pin may be used in numerous different assemblies and safety mechanisms wherever a cam action can safe and arm a weapon.

The advantages and novel features of the invention are numerous. The combination pin provides a dual function, both safing the trigger assembly and securing it to the weapon. Additionally, the single operating spring performs a dual function, both engaging the position detent and operating the ball lock mechanism. Further, removal of the pin automatically safes the trigger assembly, thereby preventing inadvertent firing during assembly or disassembly of the weapon. The dual functions serve to reduce the number and cost of parts, simplify the design, and improve reliability.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A combination pin for a small arm comprising:

a handle;

a single means, attached to said handle, for attaching a trigger assembly to said small arm and for safing said small arm; and a locking rod slidably located within said single means for securing and releasing said pin from said small arm.

2. A combination pin for a small arm as in claim 1 wherein said single means comprises a retainer pin and cam assembly.

3. A combination pin for a small arm as in claim 2 wherein said retainer pin and cam assembly further comprises a single piece housing having an insertion end and a handle end and having a smaller center bore at the insertion end and a larger center bore at the handle end, the two center bores being connected and thereby forming a single center bore with differing internal diameters at either end, and having transverse slots through the pin.

4. A combination pin for a small arm as in claim 3 wherein said retainer pin and cam assembly further comprise a detent engagement mechanism slidably attacked to said locking rod and located within said slots in the retainer pin and cam assembly.

5. A combination pin for a small arm as in claim 4 wherein said retainer pin and cam assembly further comprises a dual-action spring urging said detent engagement mechanism toward the insertion end of the combination pin and urging said locking rod toward the handle end of the combination pin.

6. A combination pin for attaching and safing a small arm trigger assembly comprising:

a retainer pin and cam assembly having an insertion end and a handle end and having a smaller center bore on the insertion end and a larger center bore on the handle end;

a plurality of locking balls located in apertures on said retainer pin and cam assembly;

a locking rod having an insertion end and a handle end inserted through the center bores of said retainer pin and cam assembly;

a washer attached to said locking rod near the handle end of said rod;

a detent engagement mechanism slidably engaging said locking rod;

a dual-action spring installed over said locking rod and further located within the larger center bore section of said retainer pin and cam assembly;

a handle affixed to said retainer pin and cam assembly; and a spring pin located in said handle and securing said handle to said retainer pin and cam assembly.

* * * * *